US008005670B2

(12) United States Patent
Khalil et al.

(10) Patent No.: US 8,005,670 B2
(45) Date of Patent: Aug. 23, 2011

(54) AUDIO GLITCH REDUCTION

(75) Inventors: Hosam A. Khalil, Redmond, WA (US); Guo-Wei Shieh, Sammamish, WA (US)

(73) Assignee: Microsoft Corporation, Redmond, WA (US)

( * ) Notice: Subject to any disclaimer, the term of this patent is extended or adjusted under 35 U.S.C. 154(b) by 979 days.

(21) Appl. No.: 11/873,707

(22) Filed: Oct. 17, 2007

(65) Prior Publication Data

US 2009/0106020 A1 Apr. 23, 2009

(51) Int. Cl.
*G10L 21/02* (2006.01)
*G10L 19/00* (2006.01)

(52) U.S. Cl. ..... 704/228; 704/500

(58) Field of Classification Search ..... None
See application file for complete search history.

(56) References Cited

U.S. PATENT DOCUMENTS

| | | | | |
|---|---|---|---|---|
| 6,044,434 | A | 3/2000 | Oliver | |
| 6,697,356 | B1 * | 2/2004 | Kretschmer et al. | 370/352 |
| 6,915,263 | B1 * | 7/2005 | Chen et al. | 704/500 |
| 7,233,832 | B2 | 6/2007 | Friedman et al. | |
| 2005/0058145 | A1 | 3/2005 | Florencio et al. | |
| 2006/0074637 | A1 | 4/2006 | Berreth | |
| 2006/0092282 | A1 | 5/2006 | Herley et al. | |
| 2007/0011343 | A1 | 1/2007 | Davis et al. | |
| 2007/0076704 | A1 | 4/2007 | Dube et al. | |
| 2007/0165838 | A1 | 7/2007 | Li et al. | |
| 2009/0171656 | A1 * | 7/2009 | Kapilow | 704/207 |

OTHER PUBLICATIONS

A Simplified Approach to High Quality Music and Sound over IP (5 pgs.) http://ccrma.stanford.edu/~rswilson/pubs/dafx00_sound_over_ip.pdf.

An Efficient Loss Concealment Technique for Real-time Audio Transport (5 pgs.) http://www.ee.iitb.ac.in/uma/~ncc2002/proc/NCC-2002/pdf/n008.pdf.

Loss Concealment for Multi-Channel Streaming Audio (10 pgs.) http://delivery.acm.org/10.1145/780000/776339/p100-sinha.pdf?key1=776339&key2=7983067811&coll=GUIDE&dl=GUIDE&CFID=27226034&CFTOKEN=80090091.

* cited by examiner

*Primary Examiner* — Brian L Albertalli
(74) *Attorney, Agent, or Firm* — Merchant & Gould P.C.

(57) ABSTRACT

To reduce audio glitch rendering buffer of an audio application is pre-filled with natural sounding audio rather than zeros. For every frame of audio sent for rendering, the rendering buffer is also pre-filled or the signal is stretched in the buffer in anticipation of a glitch. If the glitch does not occur, then the stretched signal is overwritten and the end user does not notice it. If the glitch does occur, then the rendering buffer is already filled with a stretched version of the previous audio and may result in sound that is acceptable. After recovery from the glitch, any new data is smoothly merged into the fake audio that was generated before.

20 Claims, 7 Drawing Sheets

AUDIO GLITCH REDUCTION

BACKGROUND

In real-time communication applications, the end-to-end latency from mouth to ear is desired to be kept at a minimum. As a result, the application strives to cut out any audio pipeline buffering in the system. On the other hand, the audio device is typically driven by a clock independent of a main clock of the system (e.g. the processor clock) and requires buffering to ensure uninterrupted audio rendering. If the main clock is blocked for any reason, then the application does not have enough time to fill the rendering buffer before the audio device picks up the data in the buffer to feed to the digital-to-analog converter. This result is termed an audio glitch.

To ensure smooth playback, buffering is necessary for the rendering device contradicting the requirement for low latency. A majority of real-time applications choose a buffering length that is a trade-off between latency and expected frequency of glitches. When a glitch happens, the rendering device picks up whatever data was in the buffer. Usually, but not necessarily, that buffer is implemented as a circular buffer. The buffer is usually pre-cleared such that when a glitch happens, then predictable zero-level audio is played out.

SUMMARY

This summary is provided to introduce a selection of concepts in a simplified form that are further described below in the Detailed Description. This summary is not intended to identify key features or essential features of the claimed subject matter, nor is it intended as an aid in determining the scope of the claimed subject matter.

Embodiments are directed to reducing glitch in an audio application by pre-filling a rendering buffer with fake audio that may be a copy of a portion of previously received audio signal or a stretched signal based on previously received audio. If a glitch actually occurs, the buffered signal may be used in place of missing audio signal by smoothing a transition from the fake audio signal to the real audio signal. The fake audio signal may also be simply copied in place of the missing audio to reduce needed buffer space. Potential discontinuities between real and fake audio signals may also be smoothed employing various transition techniques.

These and other features and advantages will be apparent from a reading of the following detailed description and a review of the associated drawings. It is to be understood that both the foregoing general description and the following detailed description are explanatory only and are not restrictive of aspects as claimed.

DETAILED DESCRIPTION

As briefly described above, a glitch in an audio application may be reduced or prevented by using buffered fake audio which may be a copy of a previously received portion of real audio or a stretched version for more pleasing sound quality with the fake audio being merged into real audio using smoothing technique(s). In the following detailed description, references are made to the accompanying drawings that form a part hereof, and in which are shown by way of illustrations specific embodiments or examples. These aspects may be combined, other aspects may be utilized, and structural changes may be made without departing from the spirit or scope of the present disclosure. The following detailed description is therefore not to be taken in a limiting sense, and the scope of the present invention is defined by the appended claims and their equivalents.

While the embodiments will be described in the general context of program modules that execute in conjunction with an application program that runs on an operating system on a personal computer, those skilled in the art will recognize that aspects may also be implemented in combination with other program modules.

Generally, program modules include routines, programs, components, data structures, and other types of structures that perform particular tasks or implement particular abstract data types. Moreover, those skilled in the art will appreciate that embodiments may be practiced with other computer system configurations, including hand-held devices, multiprocessor systems, microprocessor-based or programmable consumer electronics, minicomputers, mainframe computers, and the like. Embodiments may also be practiced in distributed computing environments where tasks are performed by remote processing devices that are linked through a communications network. In a distributed computing environment, program modules may be located in both local and remote memory storage devices.

Embodiments may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process.

Figure 1:
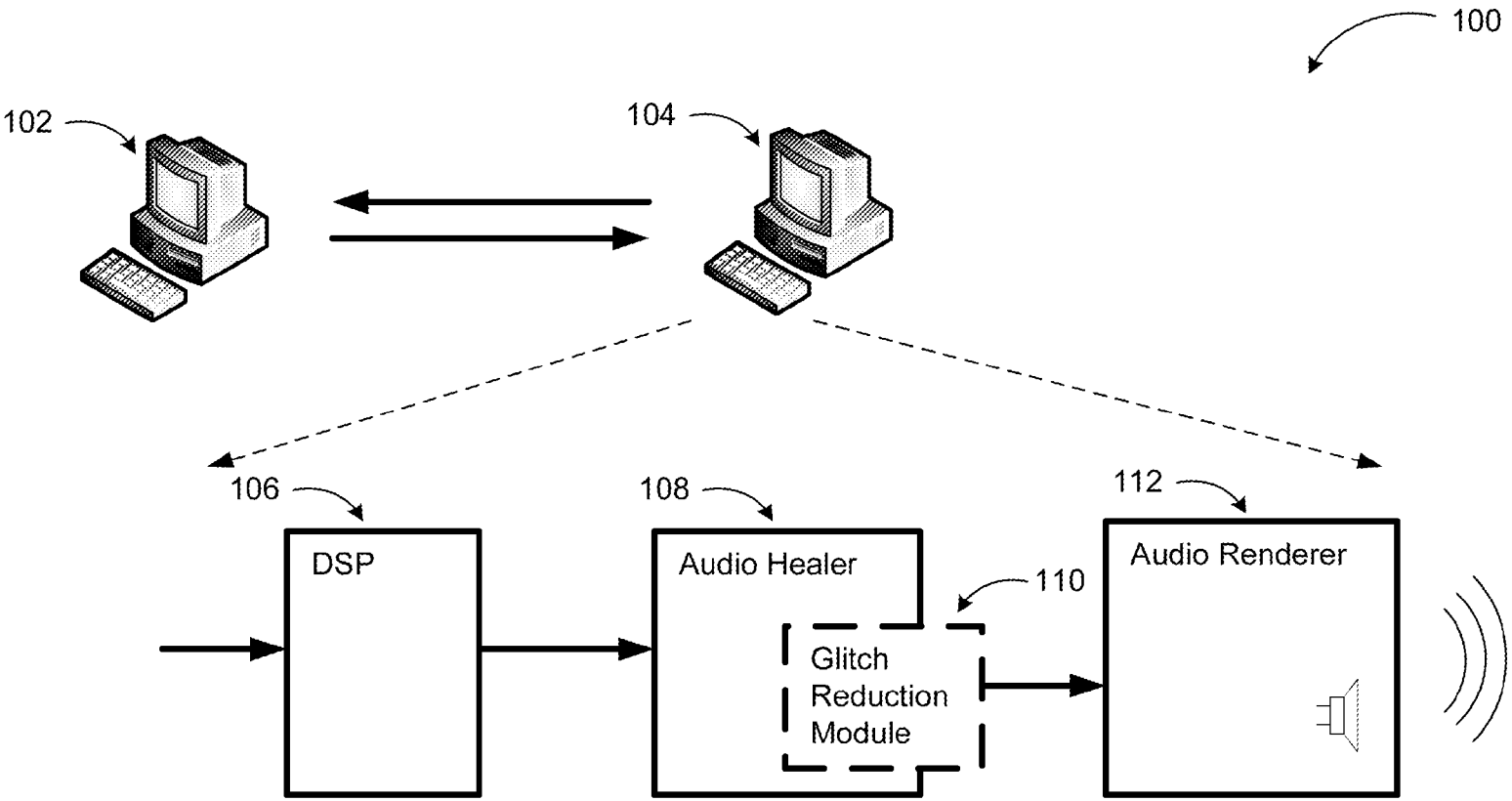
FIG. 1 is a diagram illustrating an example audio application architecture.

Referring to FIG. 1, diagram 100 of an example audio application architecture is illustrated. With the proliferation of Internet-based communication tools and applications, audio applications that provide voice communication have grown in number and variety. Such applications may be local applications residing on client devices or hosted applications executed by a service and used by a client device/application remotely. In any case, audio signals are propagated from a source device/application to the client device running the audio application, which typically processes the audio signals and renders through a rendering device. Several interfaces have become standard for simplifying the communication between the audio application and the audio rendering device.

In FIG. 1, computing device 102 represents a source for the audio signals, which may be another client device facilitating communication between two users with client device 104 or a server hosting a communication application that facilitates audio (among others) communication with a user of the client device 104. Computing device 102 may also be a source for audio files that are provided to an application on client device 104 and rendered on the client device (e.g. recordings of a radio program, etc.).

As discussed above, audio applications may perform a variety of tasks associated with processing and rendering the received audio signals. Some of these tasks may also be performed by other applications, locally or remotely. A typical audio application may include a Digital Signal Processing (DSP) block 106 for performing digital signal processing on received audio signal packets such as filtering, conditioning, biasing, etc. Audio healer 108 is another block that commonly processes the received audio signal for correcting problems, ensuring the rendered signal is acceptable (or pleasing) to the user.

Finally, audio renderer 112 renders the audio signal received from the audio healer 108 through electromechanical means, such as a speaker. Embodiments are not limited to electromechanical audio renderers, however. For example, a renderer may convert received audio signal to other types such as text (based on speech recognition) or visual presentation (waveform presentation). For simplicity, embodiments are described herein assuming an electromechanical audio renderer.

Audio renderer 112 and/or audio healer 108 may include buffer(s) for storing audio signal packets to ensure uninterrupted audio rendering. As discussed previously, the buffer may not provide adequate signal in some occasions resulting in a glitch. In an audio application according to embodiments, a glitch reduction module may be employed to minimize or prevent the occurrence of a glitch using fake audio in an acceptable and pleasing manner for the user. Such as glitch reduction module (110) may be implemented as a standalone module or as an integrated part of audio healer 108. The details of how glitch reduction module 110 reduces glitches are described in more detail below.

Figure 2A:
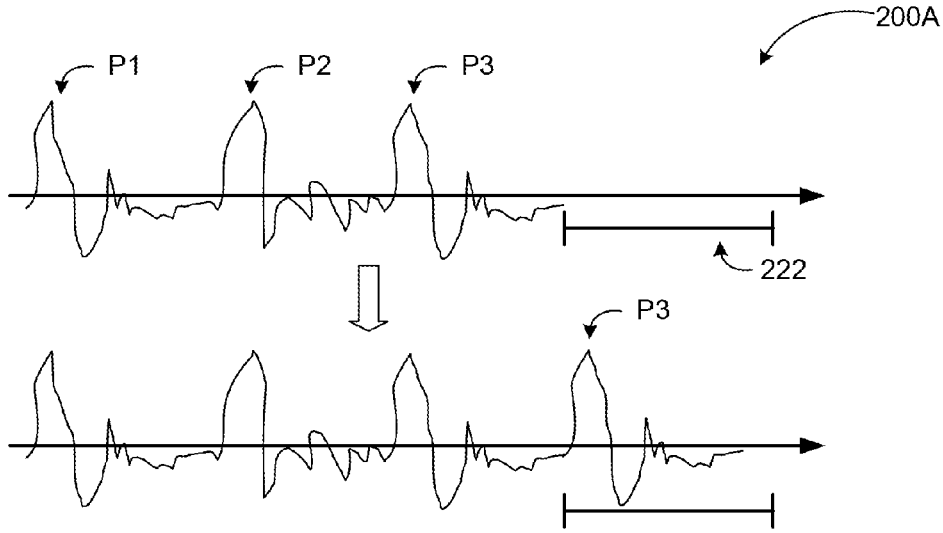
FIGS. 2A and 2B illustrate two different methods of filling in missing audio in an audio application by the audio healer module.
Figure 2B:
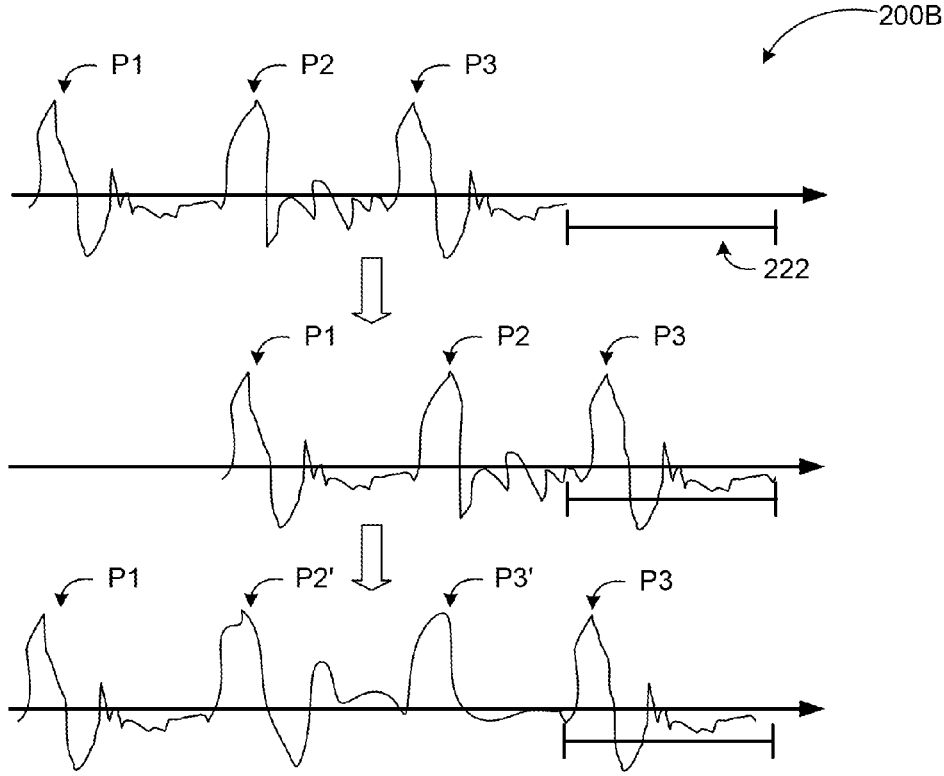

FIGS. 2A and 2B illustrate two different methods of filling in missing audio in an audio application by the audio healer module.

There are two main methods of filling in missing audio in an audio application while reducing undesirable effects such as sudden noise due to zeros in the rendering buffer being played out. Diagram 200A shows first of the two methods: copying previous audio. While this method does not require appreciable buffer space (or none at all), it results in the rendered audio such as speech sounding slightly different from real audio. For example, human speech may sound more robotic.

Generally, audio can be classified into three categories: voiced, unvoiced, and silence. Voiced sounds have very repeating patterns determined by a pitch length. Unvoiced sounds are very random in nature and have no periodicity. Silence is lack of audio data or if the level is very low such that the audio resembles white noise. A classifier may be employed by the audio application to determine the proper approach for each category. There may, however, be additional categories such the "transition" category which indicates a mix of voiced and unvoiced as speech transitions between modes. Embodiments may be implemented for any category using the principles described herein.

As mentioned above, two main methods may be employed for treating lack of audio data, especially voiced audio. According to the first method, the audio is stretched by pitch repetition. This requires that the pitch length is determined by examining the audio and then repeating the last period of audio as many times as desired to achieve objective fake audio length. For this to work, the original audio needs to be stored and storing it for the usual case when the glitch does not happen. If the glitch does not happen and the renderer has not already played part of the fake audio then the stored memory can be easily copied back again. If part of the fake audio was already played, then a glitch has occurred and the fake audio to real audio transition approach as described herein is employed. It should be noted that the audio can either be stretched by keeping real audio completely intact and just creating non-overlapping fake audio. That means there may be some discontinuity. Handling of discontinuities is discussed below in conjunction with FIG. 4B.

In diagram 200A, the voiced audio signal has three pitches P1, P2, and P3, followed by the missing audio data 222. Following the repetition stretch, the last pitch P3 is filled in place of the missing audio data 222.

In order to make the fake audio sound as acceptable as possible (i.e. as unnoticeable as possible), a more complicated second method may also be employed where the audio is stretched according to the nature of the content in such a way that the listener does not perceive the audio getting longer. This approach requires more buffer space compared to the first method and means the real audio is also affected. Therefore, the real audio must be stored in case it is needed to be reused in the absence of a glitch.

In the example stretching method shown in diagram 200B, the audio signal again has three pitches (P1, P2, P3) followed by absence of audio data 222. First the last three pitches are time shifted such that the last pitch overlaps with the missing audio data. Then the last two pitches of the real audio and the first two pitches of the time-shifted audio are combined in a weighted manner such that the new signal has pitches: P1, P2', P3', and P3, where P2' and P3' are weighted combinations of pitches P2, P1 and P3, P2, respectively. This way, the characteristics of the real audio is modified minimally while a monotone repetition in the end is avoided resulting in a more natural sounding and more pleasing audio signal.

Of course, the stretch method described above is not limited to using three pitches. Any number of pitches may be used depending on available buffer space, type of audio data, and processing power. Moreover, the weighting of the pitches for the combination may be predefined based on a number of factors. The weighting may also be determined dynamically.

Unvoiced audio signal is very random in nature, and several approaches are known to stretch this signal without introducing annoying distortions. For example, new random noise may be passed through filters matching the previous frames spectrum and so on.

Figure 3:
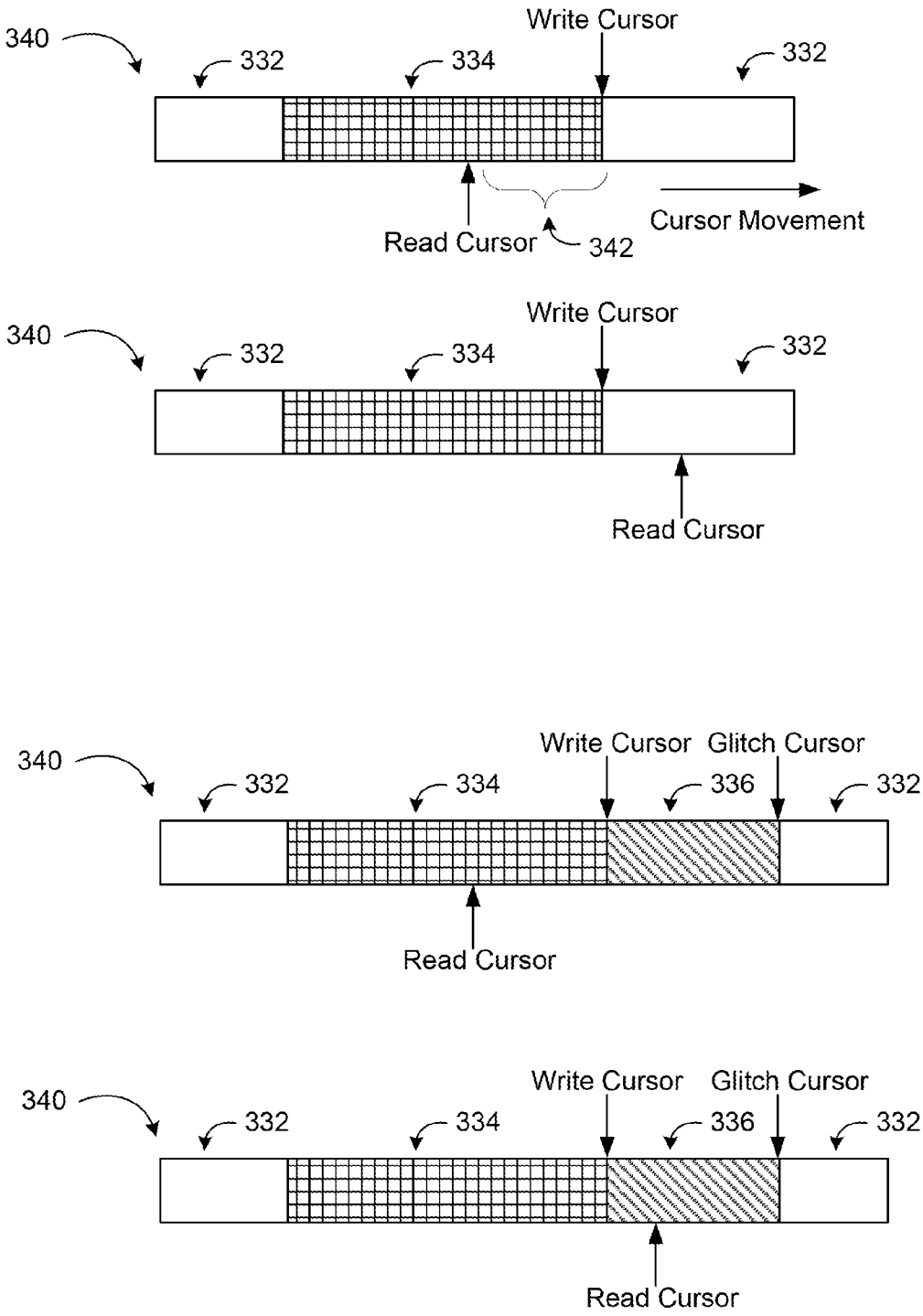
FIG. 3 illustrates audio packet structure in a buffer and occurrence of a glitch.

FIG. 3 illustrates audio packet structure in a buffer and occurrence of a glitch. In some audio applications, a circular buffer 340 is used as an intermediate buffer between the application and the rendering device. The rendering device is driven by its own clock and picks up audio samples from the buffer to send to the digital-to-analog converter. The device updates a "read" cursor indicator to indicate its current rendering position (i.e. which sample is being currently rendered).

The application itself runs based on another clock (e.g. CPU clock) and has to determine if sufficient audio data (334) has been buffered beyond the read cursor. For example, if the application can only write samples in 20 ms chunks, then it has to make sure more than 20 ms is stored in the buffer so that the rendering device does not run out of samples. The application can use a "write" cursor to indicate its current writing position. Circular buffer 340 may also include storage space 332, which may be empty or filled with previous audio data.

The distance between the read and write cursors is considered delay (342) since that data is already available but has to be buffered until its turn comes to be rendered. If the CPU is blocked for any reason, the audio application may not receive the necessary priority to fill the circular buffer before the read cursor reaches the write cursor. If that happens, then the rendering device may play out the audio data already stored in the buffer. Usually, audio applications zero out the buffer ahead of time to make sure that old audio (from when the circular buffer wrapped last time) is not be played. Since CPU may become easily blocked, the audio applications commonly prefer to make that buffering even longer by an additional 10 or 20 ms. That in return causes an even longer delay.

In a glitch, the audio device has no choice but to play out the audio at the read cursor. The effect of the glitch, however, can be reduced or prevented by pre-filling the circular buffer ahead of time. In an audio application according to embodiments, an additional cursor named "glitch" cursor is defined. Every time data is written to the circular buffer, the write cursor is updated as usual, but the audio is also stretched for an additional number of samples (i.e. fake additional audio 336). Thus, the glitch cursor is set as write cursor+N, where N is the number of samples that can change depending on the speech and audio content. Rendering device picks up samples as usual from the read cursor. When it is time to render again, the application compares the write and read cursor. If it is determined that the fake audio 336 was played out, then the application is recovering from a glitch, albeit a reduced glitch since the fake audio was played out, not zeros. In that case, the new audio is merged into the circular buffer ensuring any discontinuities are smoothed. If there was no glitch, then the new data just overwrites the old fake audio. Subsequently, the audio in the buffer is stretched again in anticipation of a possible new glitch in the next frame time, and the process is repeated starting from the point where the rendering device picks up samples from the read cursor.

Figure 4A:
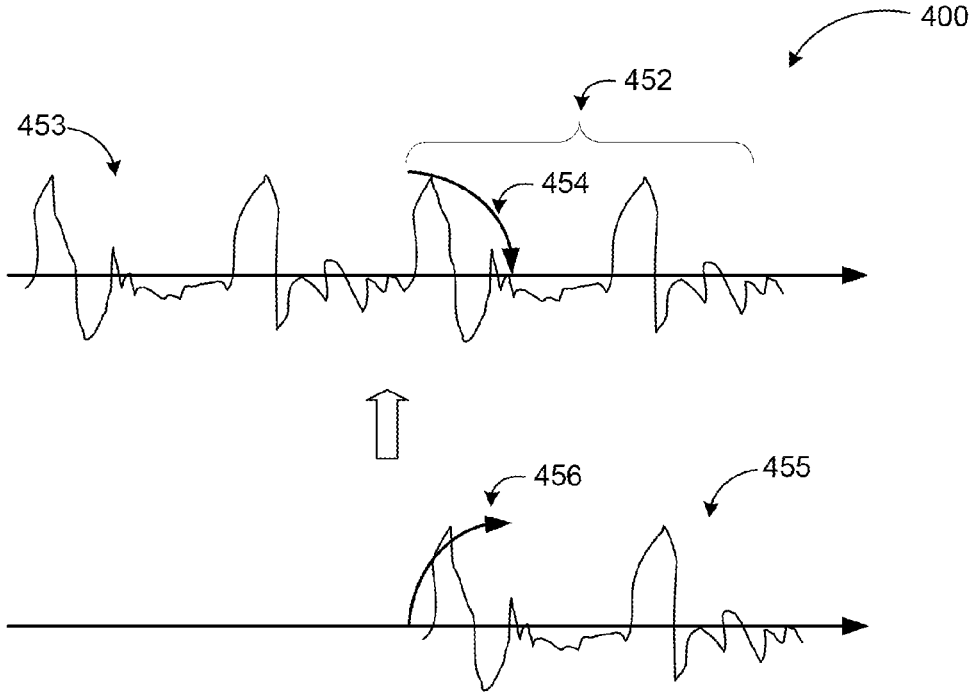
FIG. 4A is a diagram of an example glitch reduction as fake audio data is replaced by real audio data.

FIG. 4A is a diagram of an example glitch reduction as fake audio data is replaced by real audio data. When a CPU glitch happens, the read cursor moves ahead of the write cursor as described in conjunction with the previous figure. In that case, the new real data needs to be merged with the old fake data created by stretching the buffered audio.

As shown in diagram 400, fake audio signal 453 needs to be phased out, while real audio signal 455 replaces the fake audio. To accomplish this without creating an unacceptable or displeasing audio effect, first a correlation position may be determined. If the fake audio played during the glitch period is replaced with the real audio by simply appending or overwriting, click sounds may be generated due to discontinuities. Once the best correlation position (where the pitches overlap) is found, the write cursor may be updated accordingly. At that point, the remainder (452) of the fake audio signal may be reduced by ramping down (454) while the real audio (455) is ramped up (456) following the same pattern. Thus, the replacement is performed smoothly and no abrupt change can be detected by the user (listener). The new real audio data may also be stretched in anticipation of further glitches and the glitch cursor updated accordingly. The ramp up (and the ramp down) functions 454, 456 may be selected according to the type of audio, processing power, and desired quality of audio.

It should be noted that if the glitch reduction algorithm is very successful in concealing the glitches, then the buffering may be reduced leading to short end-to-end delay and savings of system resources (e.g. memory). Alternatively, the application may learn from past glitch sizes to determine how much glitch reduction needs to be done. For example, if all glitches are in the range of 10-20 ms, then the length of the produced fake audio after each frame can be set at 20 ms.

Figure 4B:
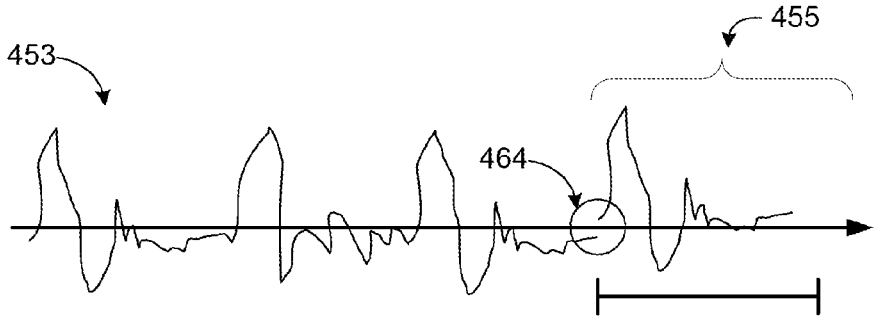
FIG. 4B is a diagram illustrating a discontinuity in audio glitch reduction that needs to be smoothed.

FIG. 4B is a diagram illustrating a discontinuity in audio glitch reduction that needs to be smoothed. As discussed above, discontinuities are another problem that may occur during the transition from fake audio (453) to real audio (455) following a glitch.

The severity of the discontinuity 464 may vary depending on where the replacement begins. While the smoothed transition using ramp up and ramp down functions described in FIG. 4A provides an overall acceptable audio transition quality, the discontinuity may still occur and create noise effects.

One of many techniques that may be implemented to reduce the effect of discontinuity is gain adjustment. The gain of the system processing the audio signal may be dynamically adjusted such that the two values of the signal on either side of the discontinuity are brought closer together. For example, the gain may be expressed as:

$$G=A/B(1-x)+x,$$

where A and B are the amplitudes of the signal on either side of the discontinuity and x=n/N with N being a predefined number. "N" may be selected based on sampling rate for example 16 samples. "n" is the index of the sample on the gain-modified side of the signal with $0<n<N-1$.

Another approach for reducing the effects of discontinuity is extrapolation and smoothing of the first signal such that the extrapolated and smoothed fake audio is closer to the beginning of the real audio at the point of replacement.

The audio glitch reduction operations and approaches, as well as components of an audio glitch reduction system, described in FIG. 1-4B are exemplary for illustration purposes. A system for reducing audio glitches may be implemented using additional or fewer components and other schemes using the principles described herein.

Figure 5:
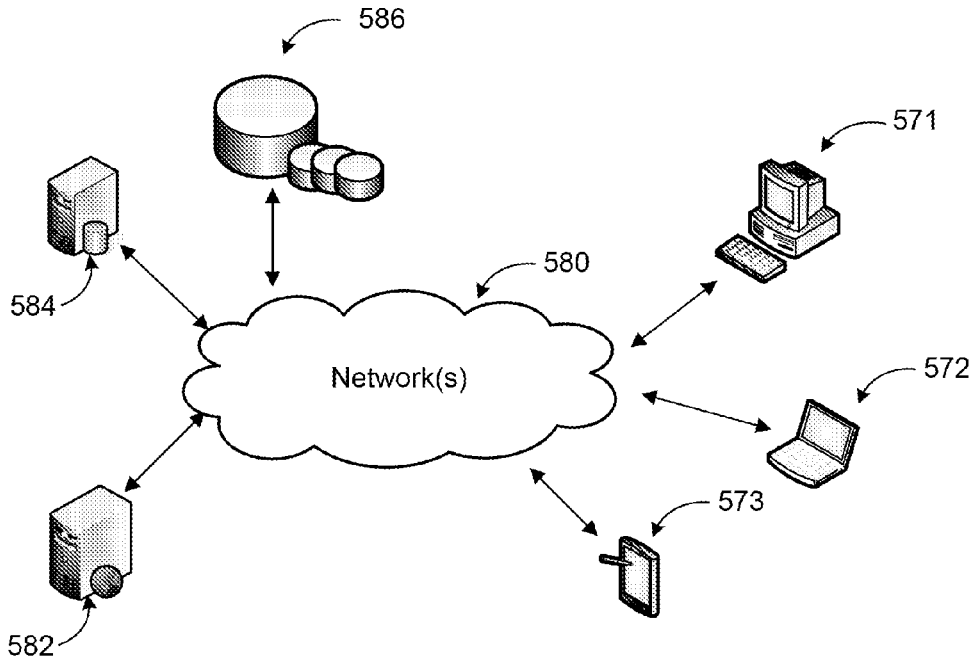
FIG. 5 illustrates a networked environment where embodiments may be implemented.

FIG. 5 is an example networked environment, where embodiments may be implemented. An application employing glitch reduction according to embodiments may be implemented locally or in a distributed manner over a number of physical and virtual clients and servers. It may also be implemented in un-clustered systems or clustered systems employing a number of nodes communicating over one or more networks (e.g. network(s) 580).

Such a system may comprise any topology of servers, clients, Internet service providers, and communication media. Also, the system may have a static or dynamic topology. The term "client" may refer to a client application or a client device. While a networked system implementing audio glitch reduction may involve many more components, relevant ones are discussed in conjunction with this figure.

Audio applications may be executed and audio rendered in individual client devices 571-573. The users themselves or a third party provider may provide plug-ins for extended or additional functionality and audio processing in the client devices. If the audio application is part of a communication application (or service), the application or service may be managed by one or more servers (e.g. server 582). A portion or all of the audio may come from stored audio files too. In that scenario, the audio files may be stored in a data store such as data stores 586 and provided to the audio application(s) in individual client devices through database server 584 or retrieved directly by the audio application(s).

Network(s) 580 may include a secure network such as an enterprise network, an unsecure network such as a wireless open network, or the Internet. Network(s) 580 provide communication between the nodes described herein. By way of example, and not limitation, network(s) 580 may include wired media such as a wired network or direct-wired connection, and wireless media such as acoustic, RF, infrared and other wireless media.

Many other configurations of computing devices, applications, data sources, data distribution systems may be employed to implement audio glitch reduction in an audio application. Furthermore, the networked environments discussed in FIG. 5 are for illustration purposes only. Embodiments are not limited to the example applications, modules, or processes.

Figure 6:
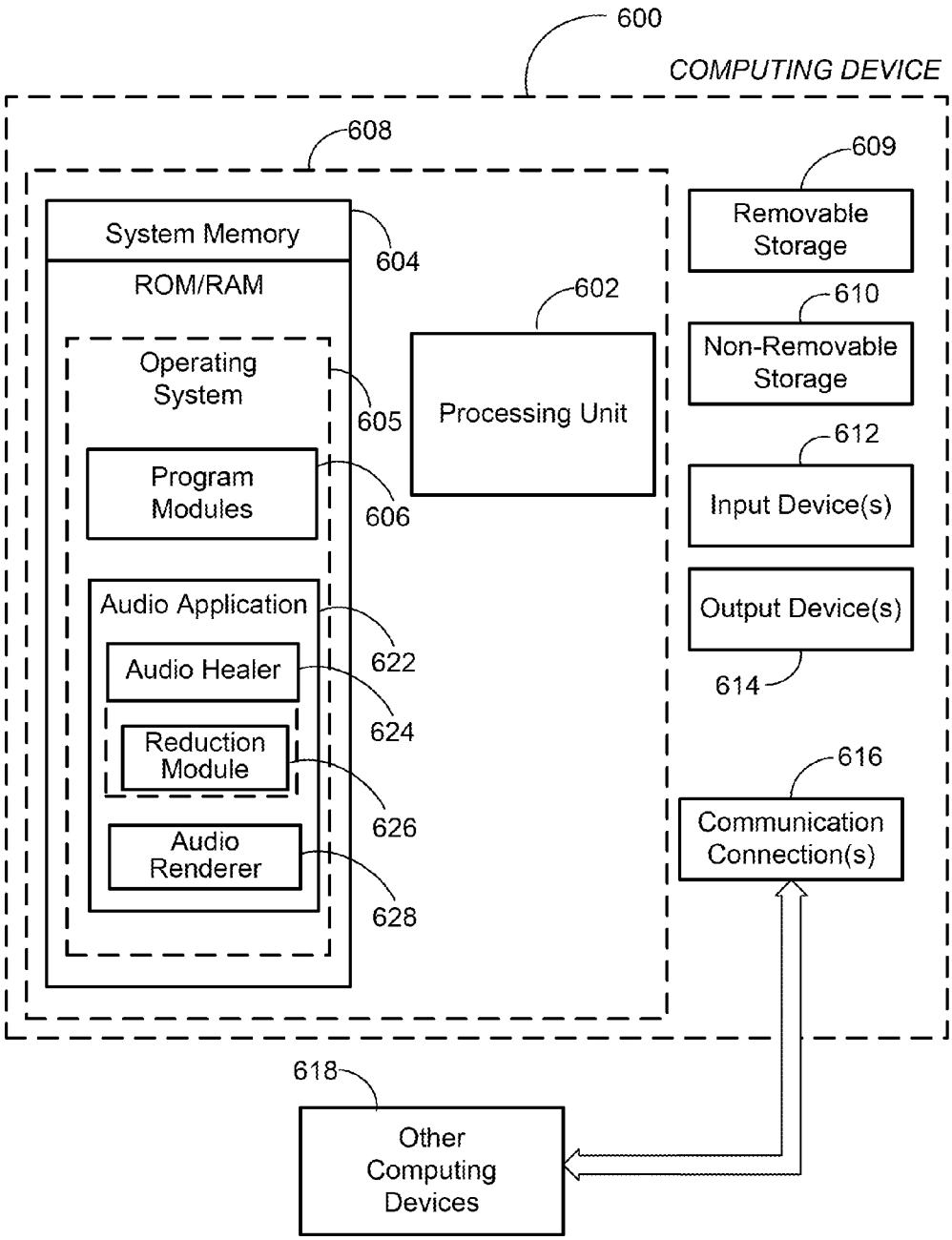
FIG. 6 is a block diagram of an example computing operating environment, where embodiments may be implemented.

FIG. 6 and the associated discussion are intended to provide a brief, general description of a suitable computing environment in which embodiments may be implemented. With reference to FIG. 6, a block diagram of an example computing operating environment is illustrated, such as computing device 600. In a basic configuration, the computing device 600 may be a client device executing an audio application and typically include at least one processing unit 602 and system memory 604. Computing device 600 may also include a plurality of processing units that cooperate in executing programs. Depending on the exact configuration and type of computing device, the system memory 604 may be volatile (such as RAM), non-volatile (such as ROM, flash memory, etc.) or some combination of the two. System memory 604 typically includes an operating system 605 suitable for controlling the operation of the computing device, such as the WINDOWS® operating systems from MICROSOFT CORPORATION of Redmond, Wash. The system memory 604 may also include one or more software applications such as program modules 606, audio application 622, audio healer module 624, glitch reduction module 626, and audio rendering module 628.

Audio application 622 may be a separate application or an integral module of a hosted service application that provides audio rendering based on received audio signals through computing device 600. Audio healer 624 provides signal processing services for improving audio quality and audio renderer 628 renders the processed audio signal to the user, as described previously. Glitch reduction module 626, which may be an independent module or part of audio healer module 624, performs operations associated with reducing or preventing glitches that may occur during the rendering of the audio signals. Glitch reduction module 626 may even reside in a driver outside the audio application 622. This basic configuration is illustrated in FIG. 6 by those components within dashed line 608.

The computing device 600 may have additional features or functionality. For example, the computing device 600 may also include additional data storage devices (removable and/or non-removable) such as, for example, magnetic disks, optical disks, or tape. Such additional storage is illustrated in FIG. 6 by removable storage 609 and non-removable storage 610. Computer storage media may include volatile and non-volatile, removable and non-removable media implemented in any method or technology for storage of information, such as computer readable instructions, data structures, program modules, or other data. System memory 604, removable storage 609 and non-removable storage 610 are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 600. Any such computer storage media may be part of device 600. Computing device 600 may also have input device(s) 612 such as keyboard, mouse, pen, voice input device, touch input device, etc. Output device(s) 614 such as a display, speakers, printer, etc. may also be included. These devices are well known in the art and need not be discussed at length here.

The computing device 600 may also contain communication connections 616 that allow the device to communicate with other computing devices 618, such as over a wireless network in a distributed computing environment, for example, an intranet or the Internet. Other computing devices 618 may include client devices or server(s) that execute applications associated with providing audio signals to audio application 622 in computing device 600. Communication connection 616 is one example of communication media. Communication media may typically be embodied by computer readable instructions, data structures, program modules, or other data in a modulated data signal, such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. The term computer readable media as used herein includes both storage media and communication media.

The claimed subject matter also includes methods. These methods can be implemented in any number of ways, including the structures described in this document. One such way is by machine operations, of devices of the type described in this document.

Another optional way is for one or more of the individual operations of the methods to be performed in conjunction with one or more human operators performing some. These human operators need not be collocated with each other, but each can be only with a machine that performs a portion of the program.

Figure 7:
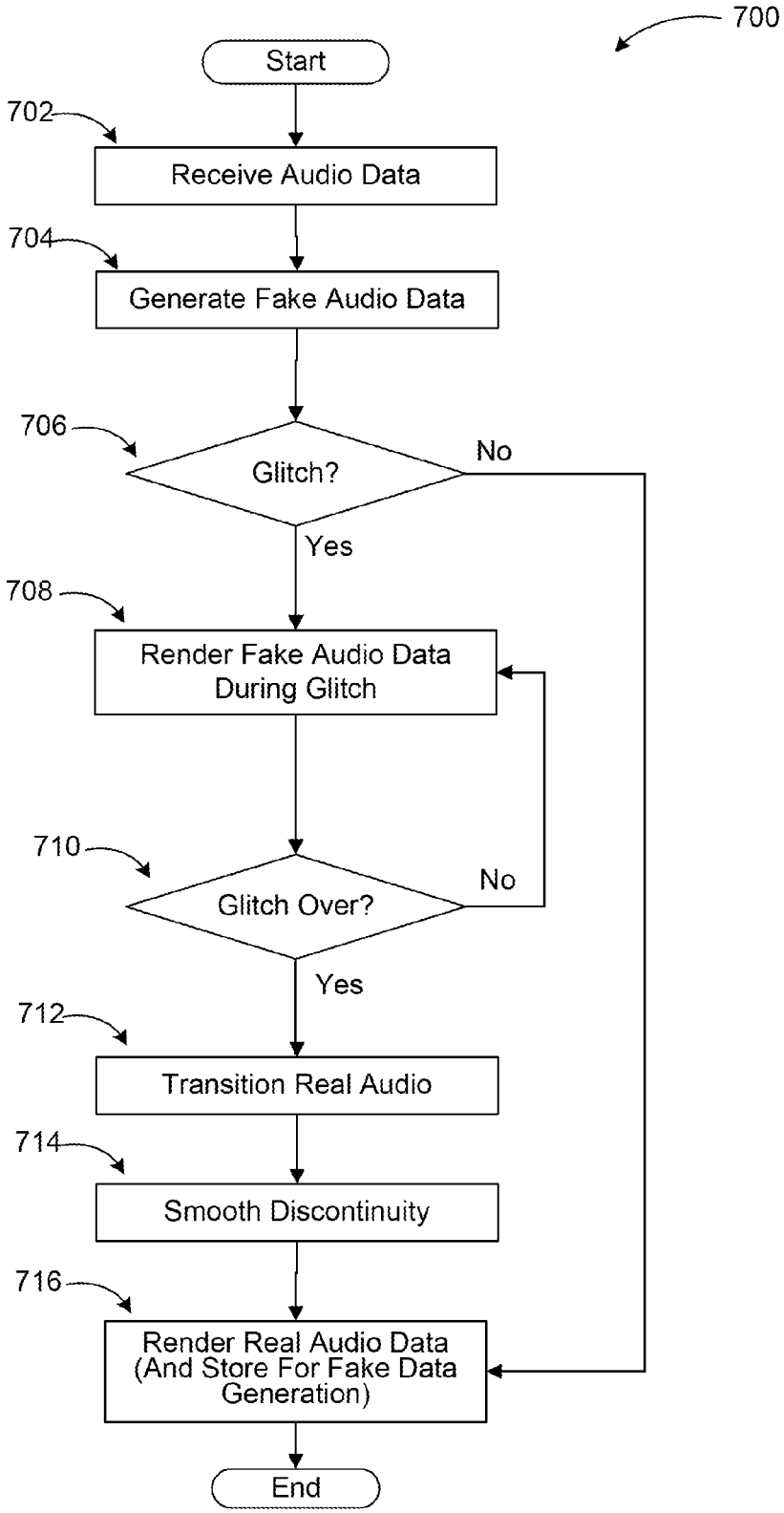
FIG. 7 illustrates a logic flow diagram for a process of audio glitch reduction according to embodiments.

FIG. 7 illustrates a logic flow diagram for process 700 of reducing audio glitch. Process 700 may be implemented, for example, as part of the audio application 622 of FIG. 6.

Process 700 begins with operation 702, where audio data is received for rendering. The audio data is stored in a circular buffer for generation of fake audio data in case of a glitch. Of course, a circular buffer is used as an interface between an audio application and a driver. A system according to embodiments reuses the same buffer for creating the glitch-reduced environment. Embodiments are also not limited to circular buffers. Other buffers may also be implemented, for example, a buffer that shifts the audio as it gets updated/rendered. Processing advances from operation 702 to operation 704.

At operation 704, fake audio data is generated. As discussed previously, this may include simple repetition of the last pitch in a voiced audio signal or generation of a more realistic fake audio portion based on a weighted combination of a predefined number of pitches of the real audio with a time-shifted version of the same data. Processing moves from operation 704 to decision operation 706.

At decision operation 706, a determination is made whether a glitch has occurred. This can be determined by comparing the positions of the read cursor and the write cursor. If the read cursor has gone beyond the write cursor, a glitch has occurred and processing continues to operation 708. Otherwise, processing skips to operation 716 where real audio data is rendered.

At operation 708, the fake audio data is rendered during the glitch. Processing moves from operation 708 to decision operation 710, where a determination is made whether the glitch is over. If the glitch is not over yet, the fake data is continued to be rendered in operation 708. If the glitch is over, processing advances to operation 712.

At operation 712, the audio signal is transitioned from the fake audio data to real audio data. For a smooth transition, the best correlation position may be first determined and then the fake audio ramped down while the real audio is ramped up resulting in a natural transition. Processing moves from operation 712 to optional operation 714.

At optional operation 714, any discontinuities may be smoothed by implementing techniques such as dynamic gain adjustment or extrapolation and smoothing. Processing advances from optional operation 714 to operation 716.

At operation 716, the real audio signal is rendered. The real audio signal may also be stored in the circular buffer for generating additional fake data in case of another glitch. After operation 716, processing moves to a calling process for further actions.

The operations included in process 700 are for illustration purposes. Reducing audio glitch may be implemented by similar processes with fewer or additional steps, as well as in different order of operations using the principles described herein.

The above specification, examples and data provide a complete description of the manufacture and use of the composition of the embodiments. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims and embodiments.

What is claimed is:

1. A method for reducing audio glitch effects, the method comprising:

receiving and rendering, by a computing device, a real audio signal;

generating, by the computing device, fake audio data based on the received real audio signal;

determining, by the computing device, if there is a glitch;

if there is no glitch, continuing, by the computing device, to render the real audio signal;

if there is a glitch, rendering, by the computing device a fake audio signal during the glitch;

when the glitch is over, transitioning, by the computing device, to a new real audio signal by ramping down the fake audio signal and ramping up the new real audio signal in a coordinated manner; and rendering, by the computing device, the new real audio signal while storing at least a portion of the new real audio signal for generating a new fake audio signal.

2. The method of claim 1, further comprising:

generating the fake audio signal by storing the real audio signal in a circular buffer, wherein a read cursor is employed to determine a rendering position on the stored audio signal and a write cursor is employed to determine a position of the latest real audio signal being stored in the circular buffer.

3. The method of claim 2, wherein a glitch is determined by comparing a position of the read cursor to a position of the write cursor.

4. The method of claim 2, further comprising:

employing a glitch cursor to indicate a position beyond the write cursor such that a predefined amount of the fake audio signal can be generated for use during a potential glitch.

5. The method of claim 1, further comprising:

when the glitch is over determining a correlation between the new real audio signal and the fake audio signal; and beginning the transitioning to the new real audio signal based on the correlation.

6. The method of claim 1, wherein the fake audio signal is generated in case of voiced audio by one of: repetition of last pitch of the real audio signal before the glitch and stretching the stored real audio signal through a weighted combination.

7. The method of claim 6, wherein stretching the stored real audio signal comprises:

determining a pitch period of the voiced audio;

time-shifting the stored real audio signal by a predefined number of pitch periods; and combining the stored real audio signal and the time-shifted signal employing a dynamic weighting factor such that a last pitch of the fake audio signal is substantially the same as a last pitch of the stored real audio signal.

8. The method of claim 7, wherein the weighting factor is determined based on at least one from a set of: a number of stored pitch periods, a desired quality of rendered audio signal, a type of audio signal, and available memory.

9. The method of claim 7, wherein the predefined number of pitch periods is determined based on at least one of: a desired quality of rendered audio signal, a type of audio signal, a system processing capability, and available memory.

10. The method of claim 1, further comprising:

detecting a discontinuity during transitioning from the fake audio signal to the new real audio signal; and reducing the discontinuity by employing at least one of: merging the fake audio signal to the new real audio signal at an optimum correlation blending point, a dynamic gain adjustment, and an extrapolation and smoothing of the fake audio signal.

11. The method of claim 10, wherein the dynamic gain adjustment comprises adjusting a gain of an audio renderer based on an amplitude of the fake audio signal before the discontinuity, an amplitude of the real audio signal after the discontinuity, and an adjustment parameter based on sample size.

12. The method of claim 10, wherein the extrapolation and smoothing of the fake audio signal comprises extrapolating the fake audio signal before the discontinuity and smoothing the extrapolated signal to match an amplitude of the real audio signal after the discontinuity.

13. The method of claim 1, wherein the fake audio signal is generated in case of unvoiced audio and silence by passing random noise through one or more filters to match a spectrum of a last segment of the real audio signal before the glitch.

14. A computing device for reducing audio glitch effects, comprising:

a memory;

a communication module configured to receive audio data from a source;

a processor coupled to the memory and the communication module, and configured to execute an audio application, the audio application comprising:

an audio healer module for:

receiving the audio data; and processing the audio data to generate a suitable real audio signal;

a glitch reduction module for:

storing at least a portion of the real audio signal in a circular buffer;

generating fake audio data by one of: pitch repetition and weighted combination of the stored portion of the real audio signal with a time-shifted version of the same signal;

determining if there is a glitch by comparing relative positions of a read cursor indicating a position of rendered audio signal and a write cursor indicating a position of latest real audio signal being stored;

if a glitch is encountered, rendering the fake audio signal during the glitch;

when the glitch is over, determining a correlation between the fake audio signal being rendered and new real audio signal, and transitioning to the new real audio signal by employing a ramp-down function on the fake audio signal and a ramp-up function on the new real audio signal in a coordinated manner;

storing at least a portion of the new real audio signal for generating new fake audio signal; and an audio rendering module for rendering the audio signal from the glitch reduction module.

15. The computing device of claim 14, wherein the glitch reduction module is an integrated part of the audio healer module.

16. The computing device of claim 14, wherein the glitch reduction module is further configured to:

reduce an amount of buffered real audio signal in response to successful glitch reduction; and determine the amount of real audio signal to be buffered based on past glitch durations.

17. The computing device of claim 14, wherein the ramp-up and the ramp-down functions are determined based on at least one from a set of: a type of real audio signal, available processing power from the processor, available memory, and a desired quality of rendered audio signal.

18. A computer-readable storage medium with instructions stored thereon for reducing effects of audio glitch, the instructions comprising:

rendering a received real audio signal while storing at least a portion in a buffer with a read cursor indicating a rendering position on the stored real audio signal and a write cursor indicating a position of the latest real audio signal being stored in the buffer;

generating fake audio data based on received real audio signal by one of: repetition of last pitch of the real audio signal before the glitch and stretching the stored real audio signal through a weighted combination;

determining if there is a glitch by comparing a position of the read cursor to a position of the write cursor;

if there is no glitch, continuing to render the real audio signal;

if there is a glitch, rendering the fake audio signal during the glitch;

when the glitch is over, transitioning to a new real audio signal by employing a ramp-down function on the fake audio signal and a ramp-up function on the new real audio signal;

reducing a discontinuity between the fake audio signal and the new real audio signal by employing one of: merging the fake audio signal to the new real audio signal at an optimum correlation blending point, a dynamic gain adjustment, and an extrapolation and smoothing of the fake audio signal; and rendering the new real audio signal while storing at least a portion of the new real audio signal for generating a new fake audio signal.

19. The computer-readable storage medium of claim 18, wherein the instructions further comprise:

employing a glitch cursor to indicate a position beyond the write cursor such that a predefined amount of the fake audio signal can be generated for use during a potential glitch, wherein the glitch is determined to have occurred if the read cursor is one of: between the write cursor and the glitch cursor and beyond the glitch cursor.

20. The computer-readable storage medium of claim 18, wherein the instructions further comprise:

transitioning from the fake audio signal to the new real audio signal by selecting the ramp-up and the ramp-down functions based on a correlation between the audio signals.

* * * * *